US008643563B2

(12) United States Patent
Cheng et al.

(10) Patent No.: US 8,643,563 B2
(45) Date of Patent: Feb. 4, 2014

(54) ANTENNA WITH EMI SHELTER

(75) Inventors: Shih-Chieh Cheng, Kaohsiung (TW); Yong-Xiang Hsieh, Chiayi County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 203 days.

(21) Appl. No.: 13/276,402

(22) Filed: Oct. 19, 2011

(65) Prior Publication Data

US 2013/0002506 A1 Jan. 3, 2013

(30) Foreign Application Priority Data

Jul. 1, 2011 (TW) ..... 100123279 A

(51) Int. Cl.
*H01Q 1/52* (2006.01)

(52) U.S. Cl.
USPC ..... 343/841; 343/700 MS; 343/702; 343/846; 343/909

(58) Field of Classification Search
USPC ..... 343/841
See application file for complete search history.

(56) References Cited

U.S. PATENT DOCUMENTS 7,106,257 B2 * 9/2006 Liu et al. ..... 343/700 MS
7,312,760 B1 * 12/2007 Cheng et al. ..... 343/702
2007/0188384 A1 * 8/2007 Liu ..... 343/700 MS

* cited by examiner

*Primary Examiner* — Jerome Jackson, Jr.
*Assistant Examiner* — Hai Tran
(74) *Attorney, Agent, or Firm* — WPAT, PC; Justin King

(57) ABSTRACT

An antenna with electromagnetic interference (EMI) shelter is disclosed, which comprises: an EMI shelter, mounted on a substrate while covering the same; a radiation unit; an induction current steering unit, disposed at a position between the EMI shelter and the radiation unit; and a signal feed-in unit, electrically connected with the radiation unit; wherein, the induction current generated by the radiation unit when it is activating is guided to the EMI shelter through the guidance of the induction current steering unit, and then to be feed into a ground connection (GND), thereby, preventing the operation of radio circuit elements that are mounted on the substrate from being interfered by the electric wave resulting from the induction current. With the aforesaid configuration, not only the EMI effect can be significantly suppressed and the overall manufacturing cost of the antenna can be effectively reduced, but also the signal transmission efficiency is improved.

10 Claims, 1 Drawing Sheet

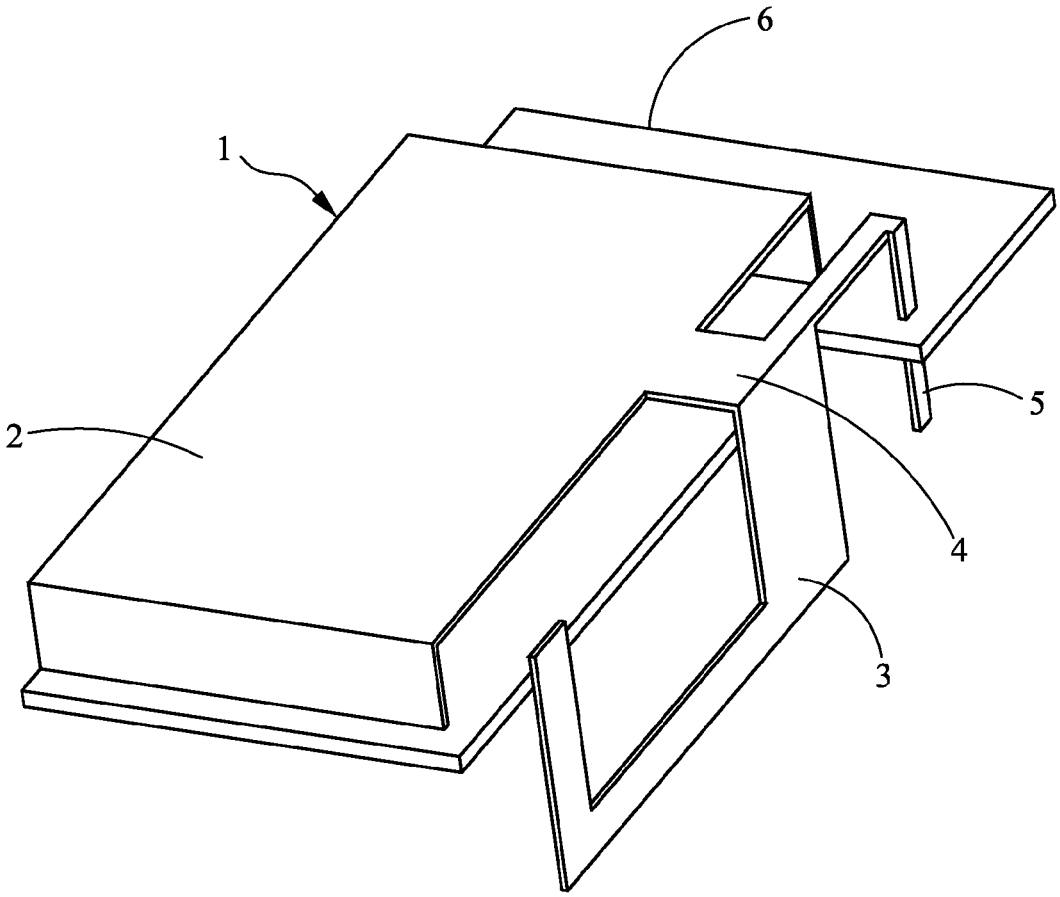
6
1
2
5
4
3

ANTENNA WITH EMI SHELTER

FIELD OF THE INVENTION

The present invention relates to an antenna with EMI shelter, and more particularly, to an antenna capable of enabling induction current from a radiation unit to flow toward an EMI shelter through the guidance of an induction current steering unit and then to be fed into a ground connection (GND), and thereby, preventing the operation of radio circuit elements that are mounted on a substrate from being interfered by the electric wave caused by the induction current while simultaneously achieving a satisfactory signal transmission efficiency.

BACKGROUND OF THE INVENTION

Nowadays, any wireless product is generally composed of a considerable amount of circuit elements, and more or less, there will be electric waves that are being generated during the operation of those circuit elements. Hence, since the modulation of electric wave, being a formed electromagnetic radiation, is the major signal transmission means for antennas used in most wireless products, the operation of wireless products are becoming more and more vulnerable to EMI effect as they are produced to meet the trend of thinner and lighter products. Conventionally, it is common to configure the wireless product with an addition shielding shell for EMI prevention. However, in addition to the increasing of manufacturing cost, such conventional EMI prevention method is preferred in view of producing a lighter wireless product.

Therefore, it is in need of an antenna with EMI shelter, that is capable of enabling induction current from a radiation unit to flow toward an EMI shelter through the guidance of an induction current steering unit and then to be fed into a ground connection (GND), and thereby, preventing the operation of radio circuit elements that are mounted on a substrate from being interfered by the electric wave caused by the induction current. Using the aforesaid configuration, not only it is not required to have each of the radio circuit elements on the substrate to be disposed a specific distance away from each of the radio circuit elements on the radiation unit for constructing an effective isolation, but also the overall size of the antenna can be effectively reduced while enabling the same to operate with satisfactory signal transmission efficiency.

SUMMARY OF THE INVENTION

The primary object of the present invention is to provide an antenna with EMI shelter, capable of enabling induction current from a radiation unit to flow toward an EMI shelter through the guidance of an induction current steering unit and then to be fed into a ground connection (GND), and thereby, preventing the operation of radio circuit elements that are mounted on a substrate from being interfered by the electric wave caused by the induction current while simultaneously achieving a satisfactory signal transmission efficiency.

In an exemplary embodiment, the present invention provides an antenna with EMI shelter, comprising: an EMI shelter, mounted on a substrate while covering the same; a radiation unit; an induction current steering unit, disposed at a position between the EMI shelter and the radiation unit; and a signal feed-in unit, electrically connected with the radiation unit; wherein, the induction current generated by the radiation unit when it is activating is guided to the EMI shelter through the guidance of the induction current steering unit, and then to be feed into a ground connection (GND), thereby, preventing the operation of radio circuit elements that are mounted on the substrate from being interfered by the electric wave resulting from the induction current.

Preferably, the radiation unit is electrically connected to the EMI shelter through the induction current steering unit while enabling the radiation unit and the EMI shelter to be coplanarly disposed.

Preferably, the radiation unit is electrically connected to the EMI shelter through the induction current steering unit while enabling the radiation unit and the EMI shelter to be disposed perpendicular to each other.

Preferably, the substrate is formed with a slot at an edge thereof so as to be used for allowing the radiation unit to inset therein and thus enabling the overall thickness of the assembled radiation unit and the substrate to be smaller then the sum of the substrate's thickness and the radiation unit's thickness, resulting that the volume of the antenna is reduced.

Preferably, the ground connection (GND) is disposed on the substrate while allowing the GND to electrically connected to the EMI shelter.

Preferably, the cross area of the induction current steering unit that is provided for permitting current to flow therethrough is smaller than the cross area of the signal feed-in unit that is provided for permitting current to flow therethrough.

Preferably, the EMI shelter, the radiation unit, the induction current steering unit and the signal feed-in unit are integrally formed as an integrated metal structure.

Preferably, the substrate is substantially a printed circuit-board.

With the aforesaid configuration, not only the EMI effect can be significantly suppressed and the overall manufacturing cost of the antenna can be effectively reduced, but also the signal transmission efficiency is improved.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein:

FIG. 1 is a three-dimensional view of an antenna with EMI shelter according to an embodiment of the invention.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Please refer to FIG. 1, which is a three-dimensional view of an antenna with EMI shelter according to an embodiment of the invention. As shown in FIG. 1, an antenna with EMI shelter 1 is provided, which comprises: an EMI shelter 2, mounted on a substrate 6 while covering the same; a radiation unit 3; an induction current steering unit 4, disposed at a position between the EMI shelter 2 and the radiation unit 3; and a signal feed-in unit 5, electrically connected with the radiation unit 3; wherein, the induction current generated by the radiation unit 3 when it is activating is guided to the EMI shelter 2 through the guidance of the induction current steering unit 4, and then to be feed into a ground connection (GND), thereby, preventing the operation of radio circuit elements that are mounted on the substrate 6 from being interfered by the electric wave resulting from the induction current. There is no specific requirement relating to how and where the substrate 6 should be covered by the EMI shelter 2, only if the covering should sufficiently reducing the EMI of the induction current, and thus can be adjusted at will as required. Generally, for effectively steering the flowing of the induction current, the GND is mostly being disposed on the substrate 6 and thus the induction current can be discharged effected through the electrical connection between the EMI shelter and the GND. Moreover, in order to produce an antenna with better transceiving ability and with lower manufacture cost, the EMI shelter 2, the radiation unit 3, the induction current steering unit 4 and the signal feed-in unit 5 are integrally formed as an integrated metal structure. It is noted that copper is usually the selected metal for making such integrated metal structure in view of today's technology.

To sum up, the present invention provides an antenna with EMI shelter, capable of enabling induction current from a radiation unit to flow toward an EMI shelter through the guidance of an induction current steering unit and then to be fed into a ground connection (GND), and thereby, preventing the operation of radio circuit elements that are mounted on a substrate from being interfered by the electric wave caused by the induction current while simultaneously achieving a satisfactory signal transmission efficiency.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An antenna with electromagnetic interference (EMI) shelter for preventing electromagnetic interference to a substrate, comprising:

an EMI shelter, mounted on a ground connection of said substrate, wherein said EMI shelter is parallel and separated from said substrate;

a radiation unit, positioned perpendicular to said substrate;

an induction current steering unit, disposed between the EMI shelter and the radiation unit; and a signal feed-in unit, electrically connected with the radiation unit, wherein said signal feed-in unit is perpendicular to said substrate;

wherein, an induction current, generated by the radiation unit when the radiation unit is activated, is guided to the EMI shelter through the induction current steering unit, and is then fed into said ground connection.

2. The antenna of claim 1, wherein the EMI shelter, the radiation unit, the induction current steering unit and the signal feed-in unit are integrally formed as an integrated metal structure.

3. The antenna of claim 1, wherein the substrate is substantially a printed circuitboard.

4. The antenna of claim 1, wherein said radiation unit is electrically connected to said EMI shelter through said induction current steering unit, and said radiation unit is perpendicular to said EMI shelter.

5. The antenna of claim 1, wherein the radiation unit is electrically connected to the EMI shelter through the induction current steering unit while enabling the radiation unit and the EMI shelter to be disposed perpendicular to each other.

6. The antenna of claim 5, wherein the substrate is formed with a notch at an edge for allowing the radiation unit to inset therein.

7. The antenna of claim 1, wherein said induction current steering unit is wider than said signal feed-in unit.

8. The antenna of claim 6 wherein said radiation unit is inset through said notch and extended from a mounting side of said substrate to an opposite side of said substrate.

9. The antenna of claim 8 wherein said radiation unit is a U shape, wherein said radiation unit extends to said opposite side of said substrate and then extends back to said mounting side of said substrate.

10. The antenna of claim 1 wherein said signal feed-in unit passes through said substrate.

* * * * *